US011326501B2

(12) United States Patent
Borla

(10) Patent No.: US 11,326,501 B2
(45) Date of Patent: May 10, 2022

(54) CROSS-PIPE EXHAUST SYSTEM

(71) Applicant: David Akiba Borla, Thousand Oaks, CA (US)

(72) Inventor: David Akiba Borla, Thousand Oaks, CA (US)

( * ) Notice: Subject to any disclaimer, the term of this patent is extended or adjusted under 35 U.S.C. 154(b) by 96 days.

(21) Appl. No.: 16/666,277

(22) Filed: Oct. 28, 2019

(65) Prior Publication Data

US 2020/0191039 A1 Jun. 18, 2020

Related U.S. Application Data

(60) Provisional application No. 62/751,590, filed on Oct. 27, 2018.

(51) Int. Cl.
*F01N 13/08* (2010.01)
*F01N 13/18* (2010.01)

(52) U.S. Cl.
CPC ..... *F01N 13/08* (2013.01); *F01N 13/1805* (2013.01); *F01N 2470/14* (2013.01); *F01N 2470/16* (2013.01)

(58) Field of Classification Search
CPC .. F01N 13/08; F01N 13/1805; F01N 2470/14; F01N 2470/16
See application file for complete search history.

(56) References Cited

U.S. PATENT DOCUMENTS 4,342,195 A 8/1982 Lo
4,621,494 A 11/1986 Fujita
4,800,719 A 1/1989 Campbell
4,926,634 A * 5/1990 Putz ..... F01N 3/20 60/274
4,953,352 A 9/1990 Campbell
5,018,349 A * 5/1991 Pemberton ..... F02B 27/04 60/313
5,144,799 A * 9/1992 Barth ..... F01N 13/04 60/313
5,214,253 A 5/1993 Houston, Jr.
5,216,883 A 6/1993 Flugger
5,727,386 A 3/1998 Watanabe et al.
5,740,671 A 4/1998 Jones
6,247,305 B1 6/2001 Bassani
6,478,340 B1 11/2002 Butler
6,662,900 B2 12/2003 Cathcart et al.
7,426,980 B2 9/2008 Bassani
7,596,944 B2 * 10/2009 Mueller ..... B01F 3/02 60/323

(Continued)

*Primary Examiner* — Anthony Ayala Delgado
(74) *Attorney, Agent, or Firm* — Robinson IP Law, PLLC

(57) ABSTRACT

A cross-pipe exhaust assembly includes: a first inlet collector splitting into an upper outlet and a lower outlet; a second inlet collector splitting into an upper outlet and a lower outlet; a first outlet collector joining an upper inlet and a lower inlet into a single outlet of the first outlet collector; a second outlet collector joining an upper inlet and a lower inlet into a single outlet of the second outlet collector; a first inline conduit located between the first inlet collector and the first outlet collector; a second inline conduit located between the second inlet collector and the second outlet collector; a first crossover conduit extending between the first inlet collector and the second outlet collector; and a second crossover conduit extending between the second inlet collector and the first outlet collector.

14 Claims, 7 Drawing Sheets

(56) References Cited

U.S. PATENT DOCUMENTS

| | | | | |
|---|---|---|---|---|
| 7,610,748 | B2 | 11/2009 | Kono et al. | |
| 7,856,815 | B2 | 12/2010 | Demura et al. | |
| 7,866,709 | B2 | 1/2011 | Spieth et al. | |
| 8,181,732 | B1 | 5/2012 | Butler | |
| 8,209,972 | B2 | 7/2012 | Tüch | |
| D664,906 | S * | 8/2012 | Lucas | D12/194 |
| 8,474,252 | B2 | 7/2013 | Butler | |
| D696,614 | S | 12/2013 | Lee et al. | |
| 8,826,651 | B2 * | 9/2014 | Laube | F01N 13/04 60/299 |
| 8,869,932 | B2 | 10/2014 | Butler et al. | |
| 9,284,868 | B2 | 3/2016 | Pommerer et al. | |
| 9,605,580 | B2 * | 3/2017 | Drees | F01N 13/04 |
| 9,945,280 | B2 * | 4/2018 | Eichmueller | F01N 13/02 |
| 10,753,264 | B2 * | 8/2020 | Klemenc | F01N 1/023 |

* cited by examiner

CROSS-PIPE EXHAUST SYSTEM

CROSS-REFERENCE TO RELATED APPLICATION(S)

This application claims priority to and is a non-provisional of U.S. patent application Ser. No. 62/751,590 filed on Oct. 27, 2018 for a "Cross-pipe Exhaust System," the contents of which are incorporated herein by reference in its entirety.

FIELD

This disclosure relates to the field of exhaust components for vehicles. More particularly, this disclosure relates to a cross-over pipe exhaust assembly for improving flow of exhaust gases.

BACKGROUND

Internal combustion engines generate hot waste gases that are typically expelled from an exhaust port of the engine. The hot waste gases through an exhaust system including one or more pipes that direct flow of exhaust gases through the exhaust system to an exhaust pipe where the gases leave the exhaust system.

Some exhaust systems include dual pipes with each pipe corresponding to a bank of cylinders of the engine. For example, in an engine wherein cylinders are arranged in a "V", exhaust gases are expelled from exhaust ports on opposing sides of the engine. The expelled gases travel through headers into a pair of exhaust pipes. Exhaust pipes typically include several bends along lengths of the exhaust pipes between exhaust ports of the engine and an exhaust pipe. These bends can create pressure within the exhaust pipes, thereby decreasing efficiency of the engine and may create unequal pressure across exhaust pipes corresponding to separate cylinder banks of the engine.

Some exhaust systems include crossover or x-pipes that allow exhaust gas pressure from two cylinder banks to equalize. Existing crossover pipes may in some cases reduce the efficiency of exhaust flow through the exhaust system or otherwise create undesirable an undesirable sound or note of the engine emitted from the exhaust pipes. What is needed, therefore, is a cross-pipe exhaust system that improves the flow of exhaust gases from an engine.

SUMMARY

The above and other needs are met by a cross-pipe exhaust system that improves the flow of exhaust gases from an engine. In a first aspect, a cross-pipe exhaust assembly includes: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector splitting into an upper outlet and a lower outlet; a second inlet collector connected to an end of the second upstream conduit, the second inlet collector splitting into an upper outlet and a lower outlet; a first outlet collector located downstream of the first inlet collector, the first outlet collector joining an upper inlet and a lower inlet into a single outlet of the first outlet collector; a second outlet collector located downstream of the second outlet collector, the second outlet collector joining an upper inlet and a lower inlet into a single outlet of the second outlet collector; a first inline conduit located between one of the lower outlet and the upper outlet of the first inlet collector and one of the upper inlet and lower inlet of the first outlet collector; a second inline conduit located between one of the lower outlet and the upper outlet of the second inlet collector and one of the upper inlet and lower inlet of the second outlet collector; a first crossover conduit extending between one of the lower outlet and the upper outlet of the first inlet collector and one of the upper inlet and lower inlet of the second outlet collector; and a second crossover conduit extending between one of the lower outlet and the upper outlet of the second inlet collector and one of the upper inlet and lower inlet of the first outlet collector.

In one embodiment, the first inline conduit is parallel to the second inline conduit. In another embodiment, the first crossover conduit curves downward between the first inline conduit and the second inline conduit along a midpoint of the first crossover conduit. In yet another embodiment, the second crossover conduit curves upward over the downwardly curved portion of the first inline conduit at a midpoint of the second crossover conduit.

In one embodiment, the first inline conduit extends between the lower outlet of the first inlet collector and the lower inlet of the first outlet collector; the second inline conduit extends between the lower outlet of the second inlet collector and the lower inlet of the second outlet collector; the first crossover conduit extends between the upper outlet of the first inlet collector and the upper inlet of the second outlet collector; and the second crossover conduit extends between the upper outlet of the second inlet collector and the upper inlet of the first outlet collector.

In another embodiment, a portion of an inlet to both the first inline conduit and first crossover conduit at least partially overlap with an outlet of the first upstream conduit and wherein a portion of an inlet to both the second inline conduit and the second crossover conduit at least partially overlap with an outlet of the second upstream conduit.

In yet another embodiment, first ends of each of the first inline conduit, second inline conduit, first crossover conduit, and second crossover conduit are in planar alignment with second ends of each of the first inline conduit, second inline conduit, first crossover conduit, and second crossover conduit.

In one embodiment, at least a portion of the first crossover pipe is aligned with the first inline conduit and wherein at least a portion of the second crossover pipe is aligned with the second inline conduit. In another embodiment, a diameter of the first inline conduit is greater than a diameter of the first crossover conduit and wherein a diameter of the second inline conduit is greater than a conduit of the second crossover conduit.

In a second aspect, a cross-pipe exhaust assembly includes: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector splitting into an upper outlet and a lower outlet; a second inlet collector connected to an end of the second upstream conduit, the second inlet collector splitting into an upper outlet and a lower outlet; a first outlet collector located downstream of the first inlet collector, the first outlet collector joining an upper inlet and a lower inlet into a single outlet of the first outlet collector; a second outlet collector located downstream of the second outlet collector, the second outlet collector joining an upper inlet and a lower inlet into a single outlet of the second outlet collector; a first inline conduit located between the lower outlet of the first inlet collector and the lower inlet of the first outlet collector; a second inline conduit located between the lower outlet of the second inlet collector and the lower inlet of the second outlet collector; a first crossover conduit extending between the upper outlet of the first inlet collector and the upper inlet of the second outlet collector; and a second crossover conduit extending between the upper outlet of the second inlet collector and the upper inlet of the first outlet collector.

In one embodiment, the first inline conduit is parallel to the second inline conduit. In another embodiment, the first crossover conduit curves downward between the first inline conduit and the second inline conduit along a midpoint of the first crossover conduit. In another embodiment, the second crossover conduit curves upward over the downwardly curved portion of the first inline conduit at a midpoint of the second crossover conduit.

In yet another embodiment, a portion of an inlet to both the first inline conduit and first crossover conduit at least partially overlap with an outlet of the first upstream conduit and wherein a portion of an inlet to both the second inline conduit and the second crossover conduit at least partially overlap with an outlet of the second upstream conduit.

In one embodiment, first ends of each of the first inline conduit, second inline conduit, first crossover conduit, and second crossover conduit are in planar alignment with second ends of each of the first inline conduit, second inline conduit, first crossover conduit, and second crossover conduit.

In a third aspect, a cross-pipe exhaust assembly includes: a first upstream conduit in fluid communication with a first bank of cylinders of an internal combustion engine; a second upstream conduit in fluid communication with a second bank of cylinders of the internal combustion engine; a first inlet collector connected to an end of the first upstream conduit, the first inlet collector splitting into an upper outlet and a lower outlet; a second inlet collector connected to an end of the second upstream conduit, the second inlet collector splitting into an upper outlet and a lower outlet; a first outlet collector located downstream of the first inlet collector, the first outlet collector joining an upper inlet and a lower inlet into a single outlet of the first outlet collector; a second outlet collector located downstream of the second outlet collector, the second outlet collector joining an upper inlet and a lower inlet into a single outlet of the second outlet collector; a first inline conduit located between the lower outlet of the first inlet collector and the lower inlet of the first outlet collector; a second inline conduit located between the lower outlet of the second inlet collector and the lower inlet of the second outlet collector; a first crossover conduit extending between the upper outlet of the first inlet collector and the upper inlet of the second outlet collector; and a second crossover conduit extending between the upper outlet of the second inlet collector and the upper inlet of the first outlet collector.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
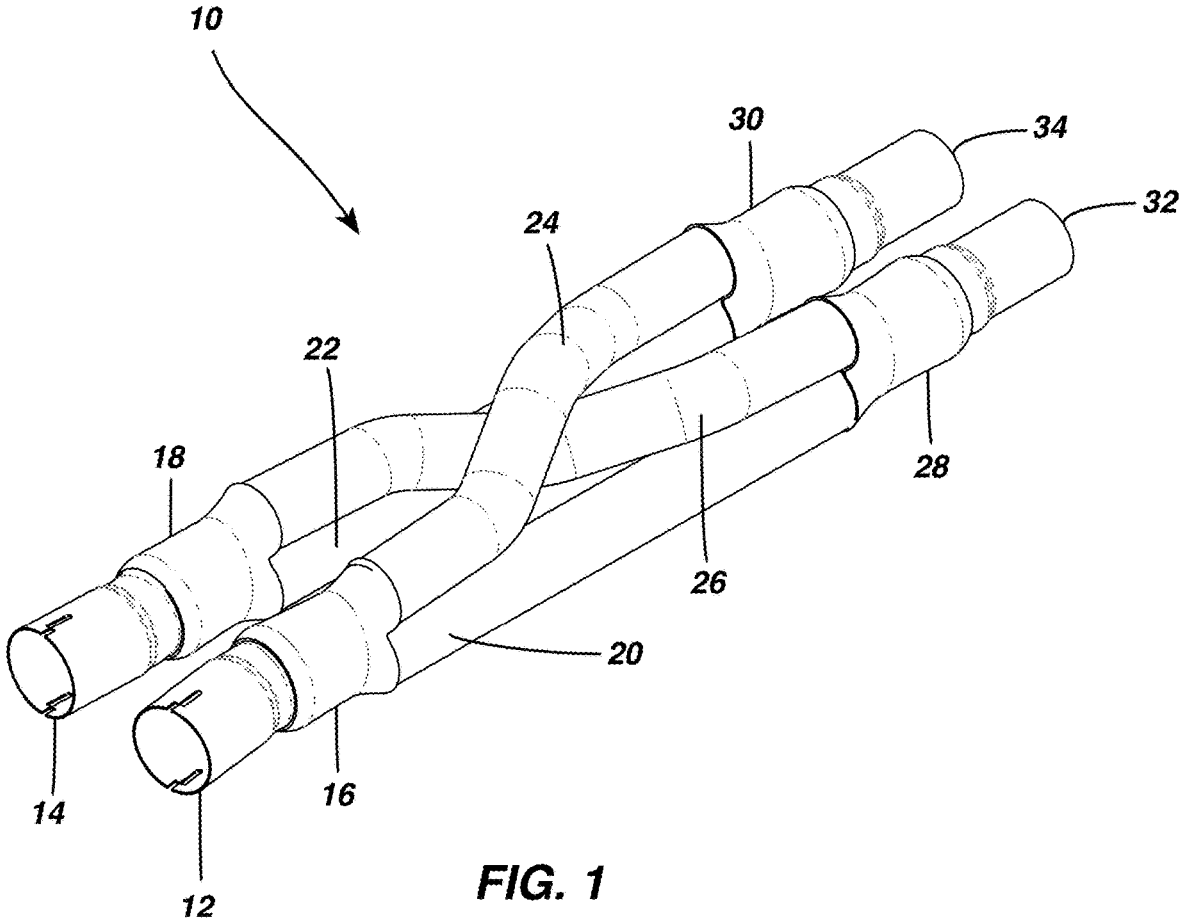
FIG. 1 shows a cross-pipe exhaust system according to one embodiment of the present disclosure.

FIG. 1 shows a basic embodiment of a cross-pipe exhaust system 10 including a plurality of pipes or conduits that are configured to allow exhaust pulses and gases from a first cylinder bank of an internal combustion engine to cross with exhaust pulses and gases from a second cylinder bank of the engine to increase efficiency of the engine and create a desirable engine sound through the exhaust. A portion of the exhaust gases are diverted to crossover while remaining exhaust gases continue to flow through the same pipe to an outlet of the exhaust. Embodiments of the cross-pipe exhaust system 10 described herein are preferably employed with internal combustion engines having at least a first bank of cylinders and a second bank of cylinders, wherein exhaust gases from each bank of cylinders are expelled into first and second headers and first and second pipes downstream from the headers. While the cross-pipe exhaust system 10 of the present disclosure is preferably employed with internal combustion engines having opposing banks of cylinders, it is also understood that embodiments of the present disclosure may be used with other various engines such that a flow of exhaust gases from a first pipe may be crossed with a flow of exhaust gases from a second pipe.

The cross-pipe exhaust system 10 includes a first inlet 12 and a second inlet 14 for receiving exhaust gases from the internal combustion engines. The first inlet 12 preferably receives exhaust gases from the first bank of cylinders and the second inlet 14 preferably receives exhaust gases from the second bank of cylinders. The first inlet 12 is in fluid communication with a first inlet collector 16 and the second inlet 14 is in fluid communication with a second inlet collector 18. The first inlet collector 16 and second inlet collector 18 are shaped to split an incoming exhaust flow from the first inlet 12 and the second inlet 14 respectively.

Figure 3:
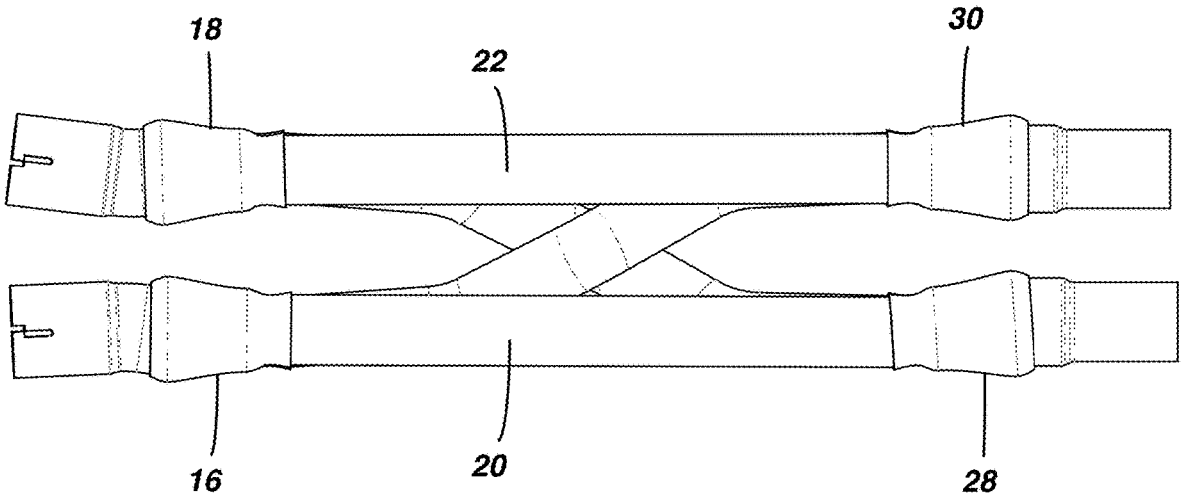
FIG. 3 shows a bottom view of a cross-pipe exhaust system according to one embodiment of the present disclosure.

Each of the first inlet collector 16 and second inlet collector 18 split an incoming exhaust flow into two separate flows such that a portion of the exhaust flow crosses the cross-pipe exhaust system 10 and such that another portion of the exhaust flow continues along an existing path of the exhaust flow. The first inlet collector 16 is in fluid communication with a first parallel pipe 20 and the second inlet collector 18 is in fluid communication with a second parallel pipe 22. The first parallel pipe 20 and second parallel pipe 22 are preferably elongate in shape having a circular cross-sectional area. The first parallel pipe 20 and second parallel pipe 22 extend from a first end to a second end that is distal from the first end. The first parallel pipe 20 and second parallel pipe 22 are preferably straight such and are preferably oriented such that the first parallel pipe 20 is substantially parallel to the second parallel pipe 22, as shown in FIG. 3.

Figure 2:
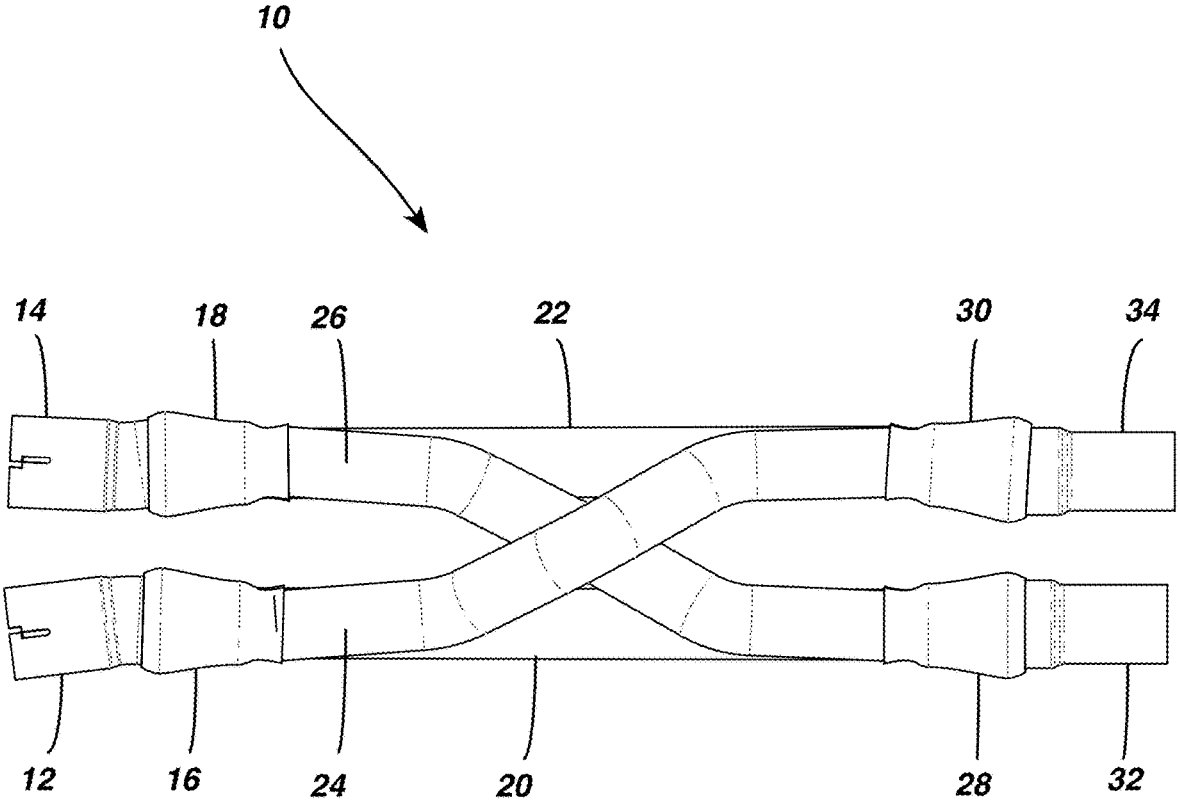
FIG. 2 shows a top view of a cross-pipe exhaust system according to one embodiment of the present disclosure.
Figure 4:
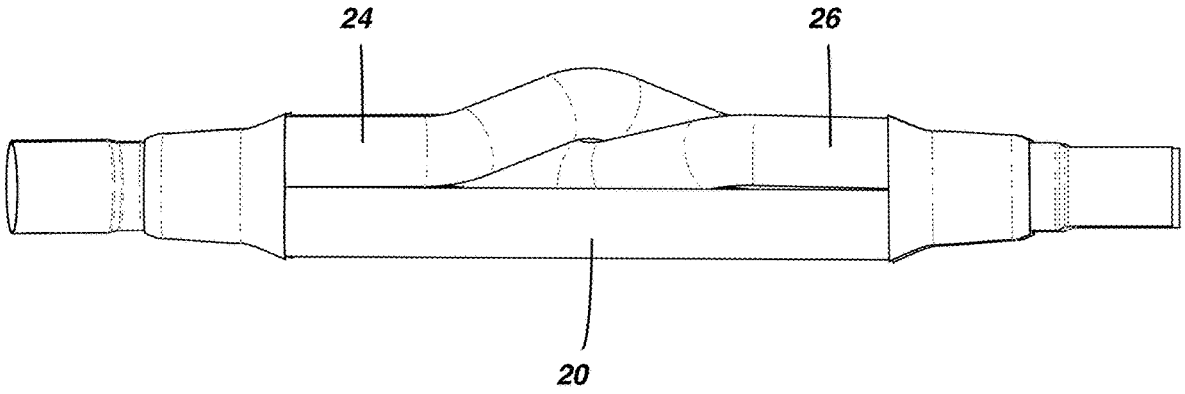
FIG. 4 shows a side view of a cross-pipe exhaust system according to one embodiment of the present disclosure.

The first inlet collector 12 is further in fluid communication with a first crossover pipe 24 and the second inlet collector 14 is further in fluid communication with a second crossover pipe 26, as shown in FIG. 2. The first crossover pipe 24 and second crossover pipe 26 are shaped such that the two cross one another between first and second ends of the first crossover pipe 24 and the second crossover pipe 26, as shown in FIG. 2. Referring to FIG. 4, the first crossover pipe 24 preferably includes a bend, such as an upward bend, formed at or near a midpoint of the first crossover pipe 24 such that the first crossover pipe 24 crosses over the second crossover pipe 26. The second crossover pipe 26 also preferably includes a bend, such as a downward bend, that is located adjacent to the bend of the first crossover pipe 24 such that the first crossover pipe 24 and second crossover pipe 26 are at least partially intertwined as shown in FIG. 4.

The first inlet collector 12 and the second inlet collector 14 preferably split a flow from a single conduit into at least two conduits, such as into the crossover pipes and inline pipes. The first inlet collector 12 and second inlet collector 14 each preferably split an entering flow into two outlets, such as an upper outlet and a lower outlet from each of the first inlet collector 12 and the second inlet collector 14.

A first outlet collector 28 is located at and in fluid communication with the distal end of the first parallel pipe 20. A second outlet collector 30 is similarly located at and in fluid communication with the distal end of the second parallel pipe 22. The distal end of the first crossover pipe 24 is in fluid communication with the second outlet collector 30, and the distal end of the second crossover pipe 26 is in fluid communication with the first outlet collector 28. A first outlet pipe 32 is in fluid communication with the first outlet collector 28 and a second outlet pipe 34 is in fluid communication with the second outlet collector 30.

The parallel pipes and crossover pipes are preferably in alignment with one another along at least a portion of lengths of the parallel pipes and the crossover pipes such that exhaust flow is gradually diverted through the crossover pipes before recombining with an opposite-side flow. For example, the first parallel pipe 20 and the first crossover pipe 24 preferably extend parallel to one another along a first section of the first crossover pipe 24 such that a direction of flow remains in a parallel direction. When the first crossover pipe 24 joins with the second parallel pipe 22 at the second outlet collector 30, the first crossover pipe 24 and second parallel pipe 22 are preferably aligned such that when the flow through the first crossover pipe 24 joins with the flow through the second parallel pipe 22 the flow is moving in a parallel direction.

Figure 5:
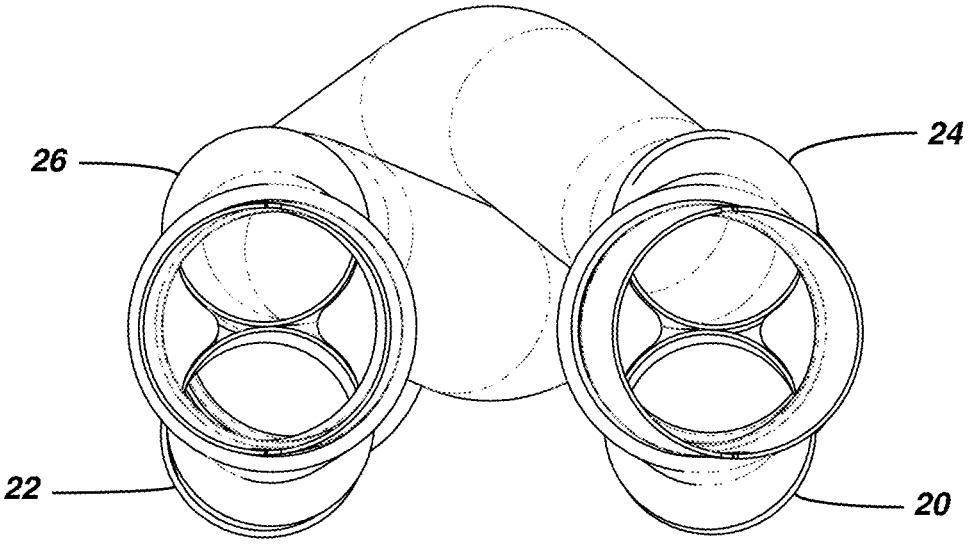
FIGS. 5 and 6 show front and rear views of a cross-pipe exhaust system according to one embodiment of the present disclosure.
Figure 6:
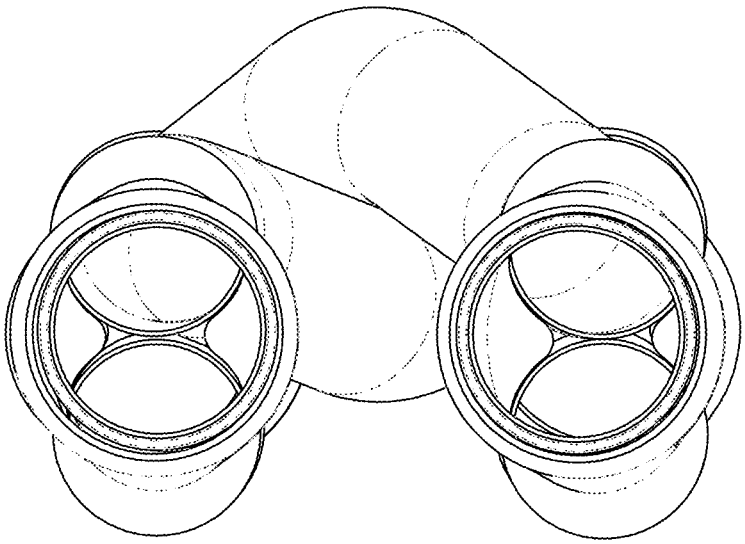

Referring to FIGS. 5 and 6, at least a portion of the parallel pipes and the crossover pipes overlaps with inlets and outlets of the inlet and outlet collectors to further smooth flow through the cross-pipe exhaust system 10. When viewed along a length of the cross-pipe exhaust system 10, at least a portion of ends of the parallel pipes and crossover pipes overlap with single inlets and single outlets of the inlet and outlet collectors such that a path of flow into the cross-pipe exhaust system 10 is minimally disturbed.

In operation, dual flows of exhaust enter the cross-pipe exhaust system 10 through the first inlet 12 and second inlet 14. A first flow corresponding to a first bank of cylinders of the engine enters the first inlet 12 and a second flow corresponding to a second bank of cylinders of the engine enters the second inlet 14. When the first and second flows enter the first inlet collector 16 and second inlet collector 18 respectively, a portion of the first flow and the second flow enters the first parallel pipe 20 and second parallel pipe 22 such that the portion of the first flow and second flow travels along a length of the first parallel pipe 20 and second parallel pipe 22 to the first outlet collector 28 and second outlet collector 30. Another portion of the first flow and the second flow enters the first crossover pipe 24 and the second crossover pipe 26. The portions of the first flow and the second flow that enter the first crossover pipe 24 and second crossover pipe 26 are joined with the opposite of the first flow and second flow in the first outlet collector 28 and second outlet collector 30.

Figure 7:
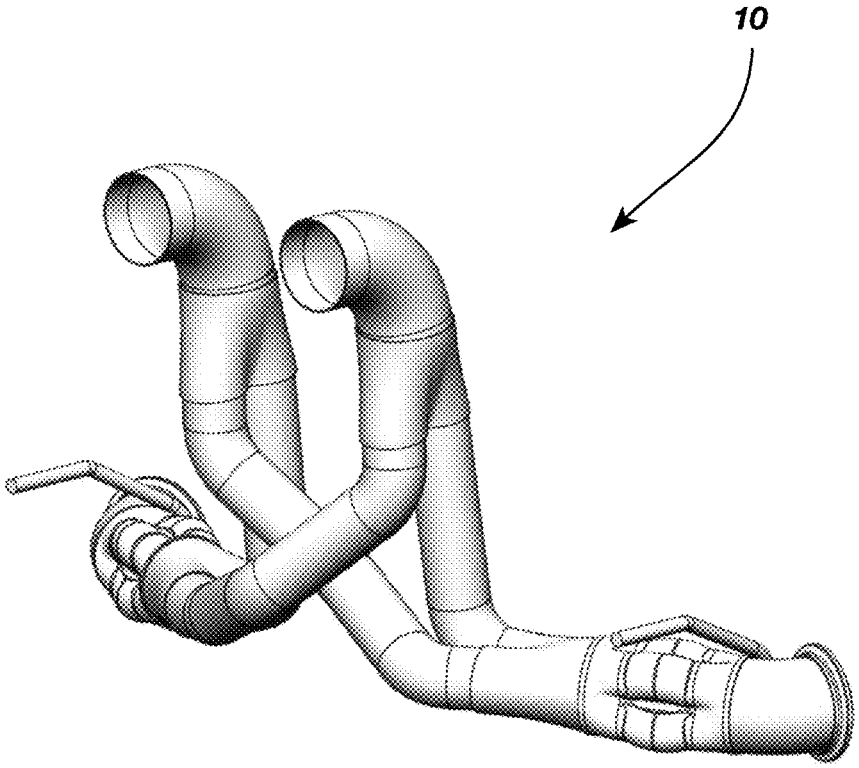
FIG. 7 shows a perspective view of a cross-pipe exhaust system according to one embodiment of the present disclosure.

While embodiments herein described include substantially parallel pipes, it is also understood that the arrangement of pipes in the cross-pipe exhaust system 10 may vary. For example, and as shown in FIG. 7, each of the parallel pipes and crossover pipes may include one or more bends along lengths of the parallel pipes and crossover pipes. In one embodiment, outlets of the outlet collectors may be offset from inlets of the inlet collectors, such as by about 90 degrees. Other various shapes may be provided along lengths of the parallel pipes and crossover pipes.

The cross-pipe exhaust system 10 of the present disclosure advantageously provides an exhaust system that allows for equalization of pressure in exhaust flow from an internal combustion engine. The cross-pipe exhaust system 10 may further improve a sound of the internal combustion engine. Shapes of pipes of the cross-pipe exhaust system 10 further reduce an amount of space required to install the cross-pipe exhaust system 10 on a vehicle, and also create a distinctive appearance.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A cross-pipe exhaust assembly comprising:

a first upstream conduit in fluid communication with a first bank of cylinders of an internal combustion engine;

a second upstream conduit in fluid communication with a second bank of cylinders of the internal combustion engine;

a first inlet collector connected to an end of the first upstream conduit, the first inlet collector splitting into an upper outlet and a lower outlet;

a second inlet collector connected to an end of the second upstream conduit, the second inlet collector splitting into an upper outlet and a lower outlet;

a first outlet collector located downstream of the first inlet collector, the first outlet collector joining an upper inlet and a lower inlet into a single outlet of the first outlet collector;

a second outlet collector located downstream of the second outlet collector, the second outlet collector joining an upper inlet and a lower inlet into a single outlet of the second outlet collector;

a first inline conduit located between one of the lower outlet and the upper outlet of the first inlet collector and one of the upper inlet and lower inlet of the first outlet collector;

a second inline conduit located between one of the lower outlet and the upper outlet of the second inlet collector and one of the upper inlet and lower inlet of the second outlet collector;

a first crossover conduit extending between one of the lower outlet and the upper outlet of the first inlet collector and one of the upper inlet and lower inlet of the second outlet collector; and a second crossover conduit extending between one of the lower outlet and the upper outlet of the second inlet collector and one of the upper inlet and lower inlet of the first outlet collector;

wherein a portion of an inlet to both the first inline conduit and first crossover conduit at least partially overlap with an outlet of the first upstream conduit and wherein a portion of an inlet to both the second inline conduit and the second crossover conduit at least partially overlap with an outlet of the second upstream conduit.

2. The cross-pipe exhaust assembly of claim 1, wherein the first inline conduit is parallel to the second inline conduit.

3. The cross-pipe exhaust assembly of claim 1, the first crossover conduit curving downward between the first inline conduit and the second inline conduit along a midpoint of the first crossover conduit.

4. The cross-pipe exhaust assembly of claim 3, the second crossover conduit curving upward over the downwardly curved portion of the first inline conduit at a midpoint of the second crossover conduit.

5. The cross-pipe exhaust assembly of claim 1, wherein:

the first inline conduit extends between the lower outlet of the first inlet collector and the lower inlet of the first outlet collector;

the second inline conduit extends between the lower outlet of the second inlet collector and the lower inlet of the second outlet collector;

the first crossover conduit extends between the upper outlet of the first inlet collector and the upper inlet of the second outlet collector; and the second crossover conduit extends between the upper outlet of the second inlet collector and the upper inlet of the first outlet collector.

6. The cross-pipe exhaust assembly of claim 1, wherein first ends of each of the first inline conduit, second inline conduit, first crossover conduit, and second crossover conduit are in planar alignment with second ends of each of the first inline conduit, second inline conduit, first crossover conduit, and second crossover conduit.

7. The cross-pipe exhaust assembly of claim 1, wherein at least a portion of the first crossover conduit is aligned with the first inline conduit and wherein at least a portion of the second crossover conduit is aligned with the second inline conduit.

8. The cross-pipe exhaust assembly of claim 1, wherein a diameter of the first inline conduit is greater than a diameter of the first crossover conduit and wherein a diameter of the second inline conduit is greater than a conduit of the second crossover conduit.

9. A cross-pipe exhaust assembly comprising:

a first upstream conduit in fluid communication with a first bank of cylinders of an internal combustion engine;

a second upstream conduit in fluid communication with a second bank of cylinders of the internal combustion engine;

a first inlet collector connected to an end of the first upstream conduit, the first inlet collector splitting into an upper outlet and a lower outlet;

a second inlet collector connected to an end of the second upstream conduit, the second inlet collector splitting into an upper outlet and a lower outlet;

a first outlet collector located downstream of the first inlet collector, the first outlet collector joining an upper inlet and a lower inlet into a single outlet of the first outlet collector;

a second outlet collector located downstream of the second outlet collector, the second outlet collector joining an upper inlet and a lower inlet into a single outlet of the second outlet collector;

a first inline conduit located between the lower outlet of the first inlet collector and the lower inlet of the first outlet collector;

a second inline conduit located between the lower outlet of the second inlet collector and the lower inlet of the second outlet collector;

a first crossover conduit extending between the upper outlet of the first inlet collector and the upper inlet of the second outlet collector; and a second crossover conduit extending between the upper outlet of the second inlet collector and the upper inlet of the first outlet collector;

wherein first ends of each of the first inline conduit, second inline conduit, first crossover conduit, and second crossover conduit are in planar alignment with second ends of each of the first inline conduit, second inline conduit, first crossover conduit, and second crossover conduit.

10. The cross-pipe exhaust assembly of claim 9, wherein the first inline conduit is parallel to the second inline conduit.

11. The cross-pipe exhaust assembly of claim 9, the first crossover conduit curving downward between the first inline conduit and the second inline conduit along a midpoint of the first crossover conduit.

12. The cross-pipe exhaust assembly of claim 11, the second crossover conduit curving upward over the downwardly curved portion of the first inline conduit at a midpoint of the second crossover conduit.

13. The cross-pipe exhaust assembly of claim 9, wherein a portion of an inlet to both the first inline conduit and first crossover conduit at least partially overlap with an outlet of the first upstream conduit and wherein a portion of an inlet to both the second inline conduit and the second crossover conduit at least partially overlap with an outlet of the second upstream conduit.

14. A cross-pipe exhaust assembly comprising:

a first upstream conduit in fluid communication with a first bank of cylinders of an internal combustion engine;

a second upstream conduit in fluid communication with a second bank of cylinders of the internal combustion engine;

a first inlet collector connected to an end of the first upstream conduit, the first inlet collector splitting into an upper outlet and a lower outlet;

a second inlet collector connected to an end of the second upstream conduit, the second inlet collector splitting into an upper outlet and a lower outlet;

a first outlet collector located downstream of the first inlet collector, the first outlet collector joining an upper inlet and a lower inlet into a single outlet of the first outlet collector;

a second outlet collector located downstream of the second outlet collector, the second outlet collector joining an upper inlet and a lower inlet into a single outlet of the second outlet collector;

a first inline conduit located between the lower outlet of the first inlet collector and the lower inlet of the first outlet collector;

a second inline conduit located between the lower outlet of the second inlet collector and the lower inlet of the second outlet collector;

a first crossover conduit extending between the upper outlet of the first inlet collector and the upper inlet of the second outlet collector; and a second crossover conduit extending between the upper outlet of the second inlet collector and the upper inlet of the first outlet collector;

wherein a diameter of the first inline conduit is greater than a diameter of the first crossover conduit and wherein a diameter of the second inline conduit is greater than a conduit of the second crossover conduit.

* * * * *